US006860048B2

(12) United States Patent
Foster et al.

(10) Patent No.: US 6,860,048 B2
(45) Date of Patent: Mar. 1, 2005

(54) OPTICAL DISC LABEL WITH PHOSPHORESCENT MATERIAL

(75) Inventors: George L. Foster, Eden Prairie, MN (US); Mark L. Kallenbach, Champlin, MN (US); Michael J. Noer, Stillwater, MN (US)

(73) Assignee: Imation Corp., Oakdale, MN (US)

( * ) Notice: Subject to any disclaimer, the term of this patent is extended or adjusted under 35 U.S.C. 154(b) by 179 days.

(21) Appl. No.: 10/231,714

(22) Filed: Aug. 30, 2002

(65) Prior Publication Data

US 2004/0040192 A1 Mar. 4, 2004

(51) Int. Cl.[7] ..... G09F 3/04

(52) U.S. Cl. ..... 40/630; 40/340; 40/638; 283/81

(58) Field of Search ..... 40/630, 340, 638; 283/81; 428/40.1, 42.1, 64.1, 354, 913, 917

(56) References Cited

U.S. PATENT DOCUMENTS 5,279,058 A * 1/1994 Kohn ..... 40/638
5,715,934 A * 2/1998 Tobol et al. ..... 40/340
5,725,169 A 3/1998 Odagiri
5,770,289 A 6/1998 Tracy
5,964,349 A 10/1999 Odagiri
6,048,595 A 4/2000 Nakajima et al.
6,279,960 B1 * 8/2001 Claussnitzer ..... 40/340
6,514,588 B2 * 2/2003 Rosenbaum et al. ..... 40/340
2003/0051383 A1 * 3/2003 Attia et al. ..... 40/638

* cited by examiner

*Primary Examiner*—Gary C. Hoge
(74) *Attorney, Agent, or Firm*—Eric D. Levinson

(57) ABSTRACT

An optical disc label including a label substrate, a writeable material, and an adhesive. The label substrate is ring-shaped, defines a front side and a back side, and includes a base layer and a phosphorescent material. The phosphorescent material is applied to the base layer and is capable of emitting absorbed energy as light. The writeable material is applied to the front side of the label substrate, and is configured to provide an indicia-receiving surface. The adhesive is applied to the back side of the label substrate. By forming the label as a ring, it can be applied to an optical disc in a manner that maintains necessary radial and/or circumferential balancing. Further, the phosphorescent material imparts a unique glow-in-the-dark property. In one preferred embodiment, the writeable material is configured to receive and maintain an inkjet printer-generated indicia.

17 Claims, 2 Drawing Sheets

OPTICAL DISC LABEL WITH PHOSPHORESCENT MATERIAL

BACKGROUND OF THE INVENTION

The present invention relates to labels for optical discs such as CDs, CD-ROMs, CD-Rs, CD-RWs, DVDs, etc. More particularly, it relates to an optical disc label including a phosphorescent material that provides a glow-in-the-dark property, and a method of preparing the same.

Optical discs are a highly popular medium used to record and electronically store data in various forms such as text, graphics, audio, video, etc. Examples of available optical disc formats include CDs, CD-ROMs, CD-Rs, CD-RWs, DVDs, etc. When optical disc technology was first introduced, only source manufacturers could program individual optical discs, and typically did so on a mass production basis. Once formatted with the desired data, the optical discs were provided to consumers with some form of printed identification information on an outer surface thereof. Because the optical discs were mass produced, it was economically feasible, and from a marketing standpoint highly desirable, to imprint stylized identification information into the optical disc's surface. While this practice is still followed today, more recently consumers have been afforded the ability to "burn" their own optical discs. That it is to say, it is now possible for a consumer to record desired data onto an otherwise "blank" optical disc. Once formatted, the user will almost certainly desire to provide some form of identification information at an outer surface of the optical disc. Unlike mass-produced, programmed optical disc manufacturers, the average consumer cannot imprint identification information to the optical disc's outer surface. Instead, consumers typically make use of a separately provided label.

In general terms, optical disc labels are formed from paperstock, with an adhesive backing for securing to a top face of the optical disc. The paperstock is normally white, and provides a surface onto which the user can hand write identification information with a writing utensil such as a pen or marker. More recently, computer programs have been developed that allow users to independently create highly stylized, professional-quality designs formatted for printing on a corresponding optical disc label. To this end, the label is provided as part of a label sheet that is otherwise sized for use with a printer, such as an inkjet printer. The user simply loads the label sheet into the printer, operates a linked computer to create the desired labeling design or image, and then prompts the printer to print the so-created design or image onto the label. Optical disc labeling software and printer technology has now evolved to the point that high resolution labeling designs can be created and printed to the label surface. To satisfy this intended use, the paperstock material employed with current optical disc labels is typically provided in a form that can maintain the resolution quality of inkjet printer-generated images. That is to say, consumers demand that ink applied to the optical disc label by a printer (such as an inkjet printer) not "bleed" or "run"; this is typically accomplished by utilizing inkjet printer receptive paper for the optical disc label.

Regardless of exact form, once applied, the optical disc label readily identifies to the user the contents of the optical disc. Under certain circumstances, however, the identification information may not be decipherable, for example, in a darkened environment. In fact, not only is it difficult, if not impossible, to read the label in the dark, users may experience difficulties even locating and/or handling the optical disc. This is an all-to-common experience when riding in an automobile during the night.

The above-described concern has been the subject of investigative efforts in the unrelated field of tape cassette labeling. In particular, a rectangular tape cassette label having a light-storing layer formed on top of a paper base layer is described, for example, in U.S. Pat. No. 6,048,595 to Nakajima et al. ("Nakajima"). The separate light-storing layer emits stored energy as light in darkened environments. Though potentially useful for labeling of tape cassettes, tape cassette labels such as that of Nakajimi are simply inapplicable for optical discs. Unlike a tape cassette, uniform placement or alignment of a separately provided label relative to the optical disc itself is highly important. In particular, an applied label that creates a radial or circumferential imbalance across the optical disc can lead to improper operation of the optical disc within an associated drive. Thus, the rectangular tape cassette label of Nakajima (and tape cassette labels in general) do not account for the delicate balancing required of optical disc labels. Further, because tape cassette labels are relatively small as compared to optical disc labels, little or no efforts have been made to create software programs capable of producing high resolution, inkjet-generated images on tape cassette labels. As such, the Nakajima tape cassette label (and similar references) fails to provide an outer surface that readily accepts and maintains inkjet printer-generated designs. Instead, the outer, writeable surface is less robust, likely formed to receive markings from a conventional ink pen.

Consumers continue to demand high quality yet inexpensive labels for labeling of optical discs. Unfortunately, currently available optical disc labels do not allow for viewing thereof in a darkened environment, and proposed solutions for tape cassette labeling fail to address the specific constraints of the optical disc environment. Therefore, a need exists for an optical disc label configured to provide a glow-in-the-dark property that does not negatively affect optical disc performance.

SUMMARY OF THE INVENTION

One aspect of the present invention relates to a label for an optical disc. The label includes a label substrate, a writeable material, and an adhesive. The label substrate is ring-shaped, and defines a front side and a back side. Further, the label substrate includes a base layer and a phosphorescent material. The phosphorescent material is applied to the base layer and is capable of emitting absorbed energy as light. The writeable material is applied to the front side of the label substrate, and is configured to provide an indicia-receiving surface. Finally, the adhesive is applied to the back side of the label substrate. By forming the label as a ring, it can be applied to an optical disc in a manner that maintains necessary radial and/or circumferential balancing. Further, the phosphorescent material imparts a unique glow-in-the-dark property. In one preferred embodiment, the writeable material, and in particular the indicia-receiving surface, is configured to receive and maintain an inkjet printer-generated indicia.

Another aspect of the present invention relates to an optical disc label sheet including a label substrate, a writeable material, an adhesive, a release liner, and a label pattern. The label substrate defines a front side and a back side, and includes a base layer and a phosphorescent material. The phosphorescent material is applied to the base layer and is capable of emitting absorbed energy as light. The writeable material is applied to the front side of the label substrate and is configured to provide an indicia-receiving surface. Conversely, the adhesive is applied to the back side of the substrate, and releasably secures the release liner thereto. Finally, the at least one label pattern is formed in the label substrate to define a ring-shaped label. In one preferred embodiment, the label substrate includes a paperstock base layer impregnated with the phosphorescent material.

Yet another aspect of the present invention relates to a method of preparing an optical disc label. The method includes providing a label sheet including a label substrate, a writeable material, an adhesive, a release liner, and a label pattern. The label substrate includes a base layer and a phosphorescent material applied thereto. The writeable material is applied to a front side of the label substrate and provides an indicia-receiving surface. Conversely, the adhesive is applied to the back side of the label substrate and releasably secures the release liner thereto. The label pattern is cut into the label substrate to define a ring-shaped label. Indicia is printed on the indicia-receiving surface of the label. The label is removed from the release liner and applied to the optical disc. Once applied, the label has a glow-in-the-dark property such that a user can readily view the printed indicia in a darkened environment. In one preferred embodiment, printing indicia on the label includes placing the label sheet in an inkjet printer with the indicia-receiving surface maintaining a desired print resolution of the printed indicia.

DETAILED DESCRIPTION OF THE PREFERRED EMBODIMENTS

Figure 1:
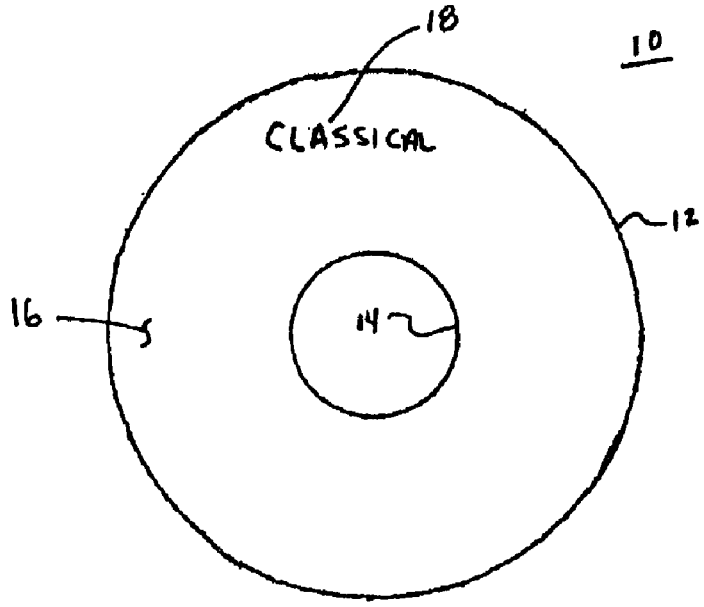
FIG. 1 is a top view of an optical disc label in accordance with the present invention.

One embodiment of an optical disc label 10 is provided in FIG. 1. The label 10 is ring-shaped, defining an outer circumference 12 and an inner circumference 14. The label 10 is properly shaped for applying to an optical disc (not shown) such as a CD, CD-R, CD-RW, or DVD. Thus, the outer circumference 12 preferably has a diameter in the range of 3.5–5.5 inches, more preferably about 5.6 inches, whereas the inner circumference 14 has a diameter in the range of 0.2–1.0 inch, more preferably about 0.7 inch. Further, and as described in greater detail below, the label 10 incorporates a phosphorescent material to provide a glow-in-the-dark property, as well as an indicia-receiving surface 16 (referenced generally in FIG. 1) capable of receiving indicia 18 in a wide variety of forms.

Figure 2:
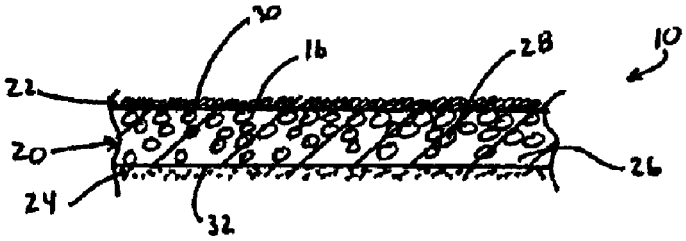
FIG. 2 is an enlarged, cross-sectional view of a portion of the label of FIG. 1.

One preferred construction of the label 10 is shown in greater detail in FIG. 2. As a point of reference, thicknesses of the various label 10 components is greatly exaggerated in FIG. 2 for purposes of illustration. With this in mind, the label 10 includes a label substrate 20, a writeable material 22, and an adhesive 24. The label substrate 20 is comprised of a base layer 26 and a phosphorescent material 28 (the particles of which are generically illustrated as relatively large circles in FIG. 2). The label substrate 20 further defines a front side 30 and a back side 32. The writeable material 22 is applied to the front side 30 of the label substrate 20, whereas the adhesive 24 is applied to the back side 32. With reference to the orientation of FIG. 1, the writeable material 22 provides the indicia-receiving surface 16, whereas the adhesive 24 serves to secure the label 10 to an optical disc (not shown).

In one preferred embodiment, the base layer 26 is a paperstock-based material useful for labeling applications, such as matte paperstock. Alternatively, other paper materials are acceptable, as are non-paper materials useful for labeling applications. As described below, the preferred base layer 26 and adhesive 24 (along with a release liner (not shown)) are provided as preformed label stock.

With the embodiment of FIG. 2 and as described in greater detail below, the preferred paperstock base layer 26 is impregnated with the phosphorescent material 28. The phosphorescent material 28 is capable of emitting absorbed energy as light, and thus provides a highly luminous (or "after glow" or "glow-in-the-dark") attribute to the label substrate 20. In a more preferred embodiment, the phosphorescent material 28 is a phosphorescent pigment that includes a fluorescent dye or compound to generate a desired color as light is emitted. A variety of phosphorescent materials 28 and pigments are available, such as zinc sulfide mixed with copper; sodium fluorescein and rhodamine; etc. One of ordinary skill will recognize that a number of other known phosphorescent materials/pigments can be employed. Regardless, the phosphorescent material 28 is preferably impregnated into the base layer 26, resulting in a uniform surface highly amenable to receiving the writeable material 22 in liquid form, as described below. An acceptable label substrate 20 impregnated with phosphorescent pigment is available from CBC Coating, Inc., of Appleton, Wis. under the trade designation "Glow In The Dark Label" Product No. 714599. This one particular label substrate 20 is initially provided as a 45.5-pound paperstock label substrate (i.e., including the adhesive 24 and a release liner) to which a phosphorescent pigment material is impregnated, resulting in an 85-pound phosphorescent label substrate/adhesive sheet, and exhibits an illumination persistence of about 30–60 minutes. Other phosphorescent materials/pigments can be used having longer persistence characteristics, such as strontium aluminate, may alternatively be employed.

As indicated by the above, the adhesive 24 can assume a wide variety of known forms useful for adhering the label 10 to an optical disc. For example, in one preferred embodiment, the adhesive 24 is an acrylic adhesive available from Wausau Coated Products of Wausau, Wis. Alternatively, other optical disc label adhesives can be employed.

The writeable material 22 is selected to provide the indicia-receiving surface 16 as previously described. In one preferred embodiment, the writeable material 22 is configured to be "inkjet receptive". In particular, the writeable material 22 forms the indicia-receiving surface 16 to readily receive handwritten notations by an ink pen and/or marker, but also to receive and consistently maintain an inkjet printer-generated indicia or image. Relative to the printer industry, and in particular inkjet printers commonly used by users of optical disc labels of the present invention, it is understood that the surface to which an inkjet printer ink is applied must be able to absorb ink quickly when passing through an imprinting device, thereby minimizing possible smudging or other distortions of the printed image (e.g., bleeding or running of the ink producing an indistinct or blurry image). To this end, many available inkjet printers are capable of delivering or printing a high-resolution image; unfortunately, for these design applications, the front side 30 of the label substrate 20 alone may be unable to maintain this desired high resolution (i.e., the printed ink does not immediately dry after inkjet printing). The writeable material 22, however, satisfies this preferred characteristic.

With the above in mind, in one preferred embodiment, the writeable material 22 is provided as an inkjet receptive solution that is coated onto the front side 30 of the label substrate 20 and then dried. This preferred material/manufacturing technique ensures complete coverage of the front side 30. One acceptable inkjet receptive solution is available from Rayven, Inc., of Saint Paul, Minn. under the trade designation "RF-1003". Alternatively, other inkjet receptive solutions can be employed. Even further, a film adapted to be inkjet receptive can be adhered to the front side 30 of the label substrate 20.

Figure 3:
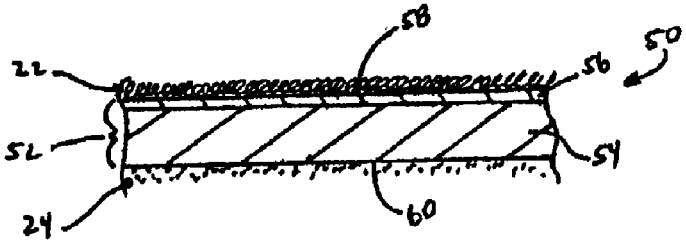
FIG. 3 is an enlarged, cross-sectional view of an alternative embodiment label in accordance with the present invention.

While the label substrate 20 has preferably been described as including the base layer 26 impregnated with the phosphorescent material 28, other configurations can be employed. For example, FIG. 3 illustrates an alternative embodiment label 50 in accordance with the present invention. The label 50 is highly similar to the label 10 (FIG. 2) previously described, and includes a label substrate 52, the writeable material 22, and the adhesive 24. The label substrate 52 is comprised of a base layer 54 and a phosphorescent material 56. Further, the substrate 52 defines a front side 58 and a back side 60. The writeable material 22 is applied to the front side 58, whereas the adhesive 24 is applied to the back side 60. While the base layer 54 and the phosphorescent material 56 can assume forms similar to that employed with the embodiment of FIG. 2 (e.g., the phosphorescent material is preferably a phosphorescent pigment), the phosphorescent material 56 is not impregnated into the base layer 54 with the embodiment of FIG. 3. Instead, the phosphorescent material 56 is coated onto a surface of the base layer 54 as shown in FIG. 3.

Figure 4A:
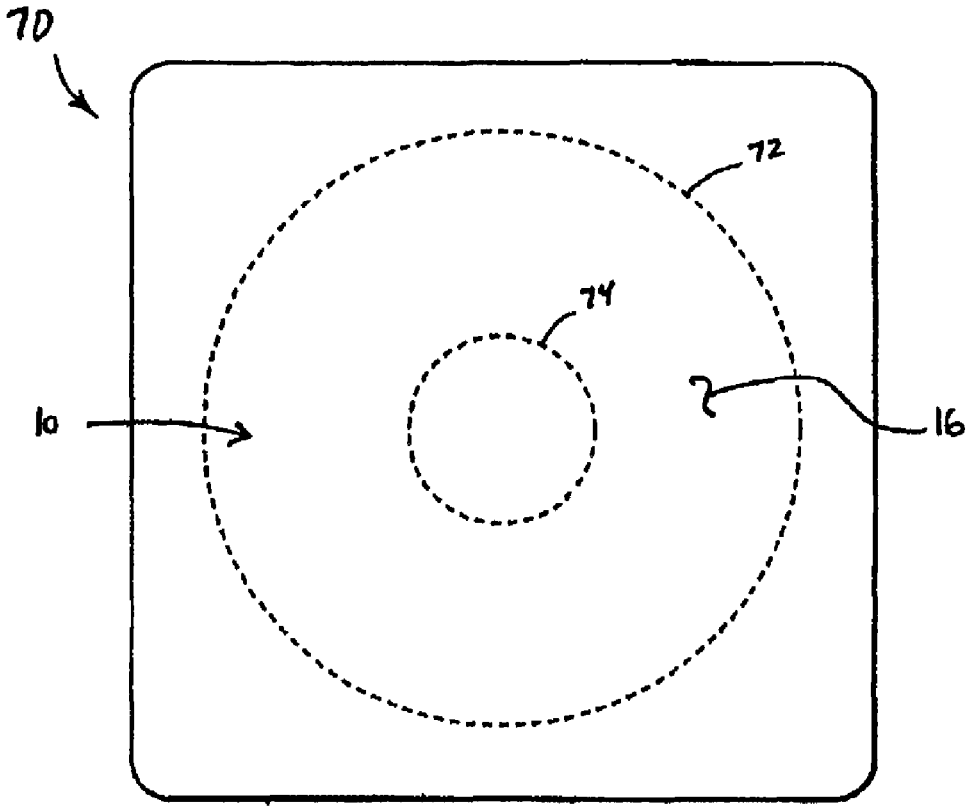
FIG. 4A is a top view of a label sheet including the label of FIG. 1.
Figure 4B:
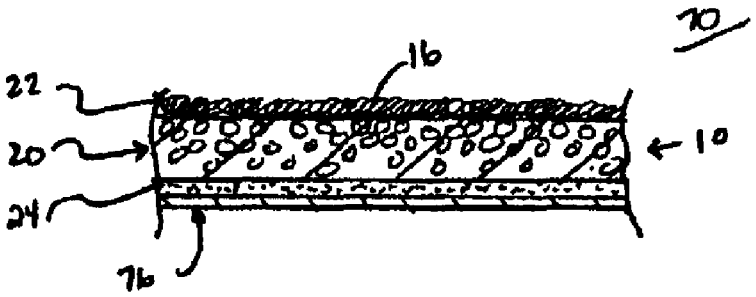
FIG. 4B is an enlarged, cross-sectional view of a portion of the label sheet of FIG. 4A.

Regardless of exact form, in a preferred embodiment, the label 10, 50 is provided to a user as part of a label sheet, one example of which is shown in FIG. 4A as element 70. The label sheet 70 is sized for handling by a conventional printer (e.g., 8½×11, A4, A5, etc.). Further, the label 10 is defined in the label sheet 70 by a cut pattern (indicated by dashed lines at 72 and 74 in FIG. 4A), it being understood that the label sheet 70 can be sized so that a plurality of labels 10 are provided. With additional reference to FIG. 4B that otherwise provides an enlarged cross-sectional view of a portion of the label sheet 70, the label sheet 70 includes the label 10 (including the label substrate 20, the writeable material 22, and the adhesive 24), along with a release liner 76. In one preferred embodiment, the release liner 76 is a semi-bleached craft liner available from Wausau Coated Products of Wausau, Wis. Alternatively, other release liners known in the art are equally acceptable. The release liner is releasably secured to the back side 32 of the label substrate 20 by the adhesive 24.

During use, the label 10 is removed from the label sheet 70, including the release liner 76, by simply peeling the release liner 76 away from the label 10 along the cut pattern 72, 74. The label 10 can then be secured to a top face of an optical disc (not shown). To this end, the indicia 18 (FIG. 1) can be formed on the indicia-receiving surface 16 before and/or after securing of the label 10 to the optical disc. Once again, the indicia 18 can be created by a hand-held writing instrument (e.g., ink pen or marker). In a preferred embodiment, at least a portion of the indicia 18 is formed on the label 10, prior to removal from the label sheet 70/release liner 76, by an inkjet printer.

EXAMPLES

A label sheet, including a label in accordance with the present invention, was prepared by first impregnating a phosphorescent material into a 45.5-pound paperstock-based label material (that included a paper layer, adhesive backing, and release liner) resulting in an 85-pound phosphorescent label sheet. The sample phosphorescent label stock sheet (without additional writeable material) was obtained from CBC Coatings, Inc. of Appleton, Wis. as "CBC Coatings Glow In The Dark Label," Item No. 714599, Grade Code 540.00 utilizing CBC's coating formulation numbers CF-210 and CF-139. An inkjet receptive solution available under the trade name "RF-1003" from Rayven, Inc., of Saint Paul, Minn. was then applied to a front side of the phosphorescent label stock via a double pass calendaring operation. The inkjet receptive solution was allowed to dry, and the resultant sheet stored in roll form. Optical disc label patterns were cut (via perforations extending through the label substrate) into the inkjet receptive coated phosphorescent label stock. Alternatively, the label patterns can be cut through the label substrate prior to adhering of the release liner and/or inkjet receptive solution coating.

The resultant label sheets and associated optical disc labels exhibited a distinct glow-in-the-dark property having a persistence of 30–60 minutes. Individual label sheets were processed through an inkjet printer, and a high-resolution image/indicia 18 (FIG. 1) printed thereon. The inkjet ink quickly dried, and virtually no smudging or other image distortion was observed. When applied to an optical disc, the label readily identified the location and general size of the optical disc in a darkened environment via the phosphorescent property. Further, the printed indicia was readily decipherable in the darkened environment due to the glow-in-the-dark backlighting provided by the label.

The optical disc label and related label sheet of the present invention provides a marked improvement over previous designs. By incorporating a phosphorescent material into a label uniquely sized for optical disc applications, a highly stylized, readily identifiable optical disc label is provided that will not otherwise negatively impact use of the optical disc. Further, by preferably providing an inkjet receptive writing material onto the label, users can utilize the label of the present invention in any desired fashion.

Although the present invention has been described with reference to preferred embodiments, workers skilled in the art will recognize that changes can be made in form and detail without departing from the spirit and scope of the present invention.

What is claimed is:

1. A label for an optical disc, the label comprising:

a ring-shaped label substrate defining a front side and a back side, the label substrate comprising a paperstock base layer impregnated with a phosphorescent material capable of emmitting absorbed energy as light;

a writeable material applied to the front side of the label substrate, the writeable material configured to provide an indicia-receiving surface capable of receiving indicia; and an adhesive applied to the back side of the label substrate.

2. The label of claim 1, wherein the label substrate defines an outer circumference and an inner circumference.

3. The label of claim 1, wherein the writeable material is coated onto the paperstock impregnated with the phosphorescent material.

4. The label of claim 1, wherein upon securing of the label to an optical disc, the label is adapted to identify an inner circumference and an outer circumference of the optical disc in a darkened environment via light emitted by the phosphorescent material.

5. The label of claim 1, wherein the indicia-receiving surface is configured to receive and maintain inkjet printer-generated indicia.

6. The label of claim 1, wherein the indicia-receiving surface is configured to retain a printed resolution of an inkjet-based indicia printed on the indicia-receiving surface by a printer.

7. The label of claim 1, wherein the writeable material is a hardened inkjet receptive solution.

8. An optical disc label sheet comprising:

a label substrate defining a front side and a back side, the label substrate comprising a paperstock base layer impregnated with a phosphorescent material capable of emitting absorbed energy as light;

a writeable material applied to the front side of the label substrate, the writeable material configured to provide an indicia-receiving surface adapted to receive indicia;

an adhesive applied to the back side of the substrate;

a release liner releasably secured to the back side of the label substrate by the adhesive; and at least one label pattern formed in the label substrate defining a ring-shaped label.

9. The label sheet of claim 8, wherein the writeable material is a hardened inkjet receptive solution.

10. A method of preparing an optical disc label, the method including:

providing a label sheet including a label substrate that includes impregnating a paperstock base layer with a phosphorescent material capable of emitting absorbed energy as light, a writeable material applied to a front side of the label substrate to provide an indicia-receiving surface, an adhesive applied to a back side of the label substrate, and a release liner releasably secured to the back side by the adhesive, wherein a pattern is cut into the label substrate to define a ring-shaped label;

printing indicia on the indicia-receiving surface;

removing the label from the release liner; and applying the label to an optical disc.

11. The method of claim 10, wherein printing indicia occurs prior to removing the label from the release liner.

12. The method of claim 10, wherein printing indicia occurs after the label is applied to the optical disc.

13. The method of claim 10, wherein printing indicia includes:

placing the label sheet in a printer; and operating the printer to apply ink on the indicia-receiving surface to form a printed pattern.

14. The method of claim 13, wherein the printer is an inkjet printer.

15. The method of claim 13, wherein operating the printer further includes:

generating an intended indicia pattern having a predetermined resolution, and further wherein the indicia-receiving surface maintains the printed pattern at a resolution approximating the predetermined resolution.

16. The method of claim 13, wherein following the step of printing with the printer, the applied ink does not flow from the printed pattern.

17. The method of claim 10, wherein providing a label sheet includes coating the front side of the label substrate with an inkjet receptive solution that, upon drying, provides the indicia-receiving surface.

* * * * *